US007095973B2

(12) United States Patent
Kwak

(10) Patent No.: US 7,095,973 B2
(45) Date of Patent: Aug. 22, 2006

(54) IMAGE FIXING DEVICE OF IMAGE FORMING APPARATUS

(75) Inventor: In-gu Kwak, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/625,736

(22) Filed: Jul. 24, 2003

(65) Prior Publication Data

US 2004/0146324 A1 Jul. 29, 2004

(30) Foreign Application Priority Data

Jul. 25, 2002 (KR) ..... 2002-43888

(51) Int. Cl.
*G03G 15/20* (2006.01)

(52) U.S. Cl. ..... 399/328; 219/216

(58) Field of Classification Search ..... 399/328–330, 399/320, 122, 334, 331, 333, 107; 219/216, 219/469

See application file for complete search history.

(56) References Cited

U.S. PATENT DOCUMENTS

| | | | | |
|---|---|---|---|---|
| 6,580,895 | B1 * | 6/2003 | Hirst et al. | 399/330 |
| 6,665,515 | B1 * | 12/2003 | Lee | 399/330 |
| 6,721,530 | B1 * | 4/2004 | Hirst et al. | 399/328 |
| 6,853,831 | B1 * | 2/2005 | Hirst et al. | 399/328 |
| 2004/0258440 | A1 * | 12/2004 | Romem | 399/330 |

* cited by examiner

*Primary Examiner*—Hoan Tran
(74) *Attorney, Agent, or Firm*—Staas & Halsey LLP

(57) ABSTRACT

An image fixing device of an image forming apparatus includes a pressure roller and a heating roller to rotate as if it is in contact with the pressure roller, with a paper fed therebetween, to fix a developed image to the paper by applying heat generated by a heating member installed inside therein. The heating roller is a heat pipe of a closed tube type. The heat pipe of the closed tube type has a fluid poured inside of a closed space thereof. The heating member is an induction heating body to generate a magnetic field to the heating roller. The heat generated by induction heating is applied to the heating roller including the heat pipe to keep a temperature around the surface thereof at a predetermined uniform level.

13 Claims, 2 Drawing Sheets

IMAGE FIXING DEVICE OF IMAGE FORMING APPARATUS

CROSS-REFERENCE TO RELATED APPLICATIONS

This application claims the priority of Korean Patent Application No. 2002-43888, filed Jul. 25, 2002, in the Korean Intellectual Property Office, the disclosure of which is incorporated herein by reference.

BACKGROUND OF THE INVENTION

1. Field of the Invention

The present invention relates to an image fixing device of an image forming apparatus, and more particularly, to an image fixing device of an image forming apparatus implementing a heating roller to apply heat to an image developed on a printing paper to fix the developed image by using a heat pipe.

2. Description of the Related Art

Generally, a copy machine, a printer, a facsimile, and a combination of these machines or the like all perform a printing function and are generally referred to as image forming apparatuses.

The image forming apparatus forms an electro-static latent image by exposing image data fed from an outside to a photoconductor, develops the formed electro-static latent image using a developing agent, and transfers the developed image onto a printing paper. The image forming apparatus fixes the transformed image to the printing paper by using an image fixing device thereof, and discharges the printed paper.

This kind of image fixing device fixes an image to the printing paper by applying heat and pressure to the paper with an image formed thereon.

FIG. 1 is a diagram showing a part of a conventional image forming apparatus employing an image fixing device. Referring to FIG. 1, the conventional image forming apparatus 100 includes an image fixing device 110, an electric power supplier 120 and an engine controller 130. The image fixing device 110 includes a heating roller 112 and a pressure roller 114.

The heating roller 112 has a multiple layer structure of 2 or 3 layers, and applies heat to a printing paper having an image formed thereon (shown in a thick solid line) to fix the image to the paper. The heating roller 112 is equipped with an internally installed induction heating coil 112*a*. The induction heating coil 112*a* generates a magnetic field by an AC electric power supplied by the electric power supplier 120.

The magnetic field generated by the induction heating coil 112*a* generates induced current on the inner surface of the heating roller 112, thereby generating a Joule's Heat. The heating roller 112 is equipped with an externally installed thermistor 112*b* to detect a temperature of the heating roller 112 heated by the induction heating coil 112*a*.

The engine controller 130 controls an electric power supply to the heating roller 112 in response to the temperature detected by the thermistor 112*b*.

The pressure roller 114 rotates as if it is in contact with the heating roller 112 to apply a pressure to the printing paper with the image transferred thereto, thereby fixing the image to the paper. The heating roller 112 and the pressure roller 114 rotate respectively in the arrowed directions as shown in FIG. 1, to discharge the printed paper.

However, the conventional heating roller 112 has a difference in temperature between both ends and a center thereof, and the difference in temperature reduces fusing efficiency. That is, cooling times required to cool the ends and the center of the induction heating coil 112*a* to a predetermined temperature differ from each other. Also, AC magnetic fields occurring around the ends and the center differ from each other, thereby deteriorating the fusing efficiency of the image.

As a result, the conventional heating roller 112 lacks a uniformity of temperature along the longitudinal direction thereof, while having a uniform temperature in the circumferential direction.

SUMMARY OF THE INVENTION

Accordingly, it is an aspect of the present invention to provide an image fixing device capable of keeping a temperature around the surface of a heating roller uniform to fix a developed image on a paper.

Additional aspects and advantages of the invention will be set forth in part in the description which follows and, in part, will be obvious from the description, or may be learned by practice of the invention.

The foregoing and/or other aspects and advantages are realized by providing a pressure roller; a heating member; and a heating roller, the heating member being installed therein, to rotate with the pressure roller to fix a developed image to a fed paper by applying heat generated by the heating member, wherein the heating roller is a heat pipe of a closed tube type.

The heat pipe of the closed tube type may have a fluid poured inside of a closed space thereof. The heating member may be an induction heating body to generate a magnetic field to the heating roller and the heating roller may be installed to rotate separately from the heating member.

In the meantime, an image fixing device of an image forming apparatus are realized by providing a pressure roller, an induction heating coil, and a heating roller, the induction heating coil being installed therein, to rotate with the pressure roller to fix a developed image to a fed paper by applying heat generated by the induction heating coil, wherein the heating roller is a heat pipe of a closed tube type.

And, an image forming apparatus are realized by providing a first roller to form an electrostatic latent image thereon, a developer to develop the electrostatic latent image, a second roller to transfer the developed image to a recording medium, and a fixing device to fix the transferred image to the recording medium, comprising: a roller to rotate about an axis to fix a toner image to the recording medium, the roller comprising an outer surface having a uniform surface temperature in a direction of the axis.

BRIEF DESCRIPTION OF THE DRAWINGS

These and other aspects and advantages of the invention will become apparent and more readily appreciated from the following description of the preferred embodiment, taken in conjunction with the accompanying drawings of which.

DETAILED DESCRIPTION OF THE PREFERRED EMBODIMENTS

Figure 1:
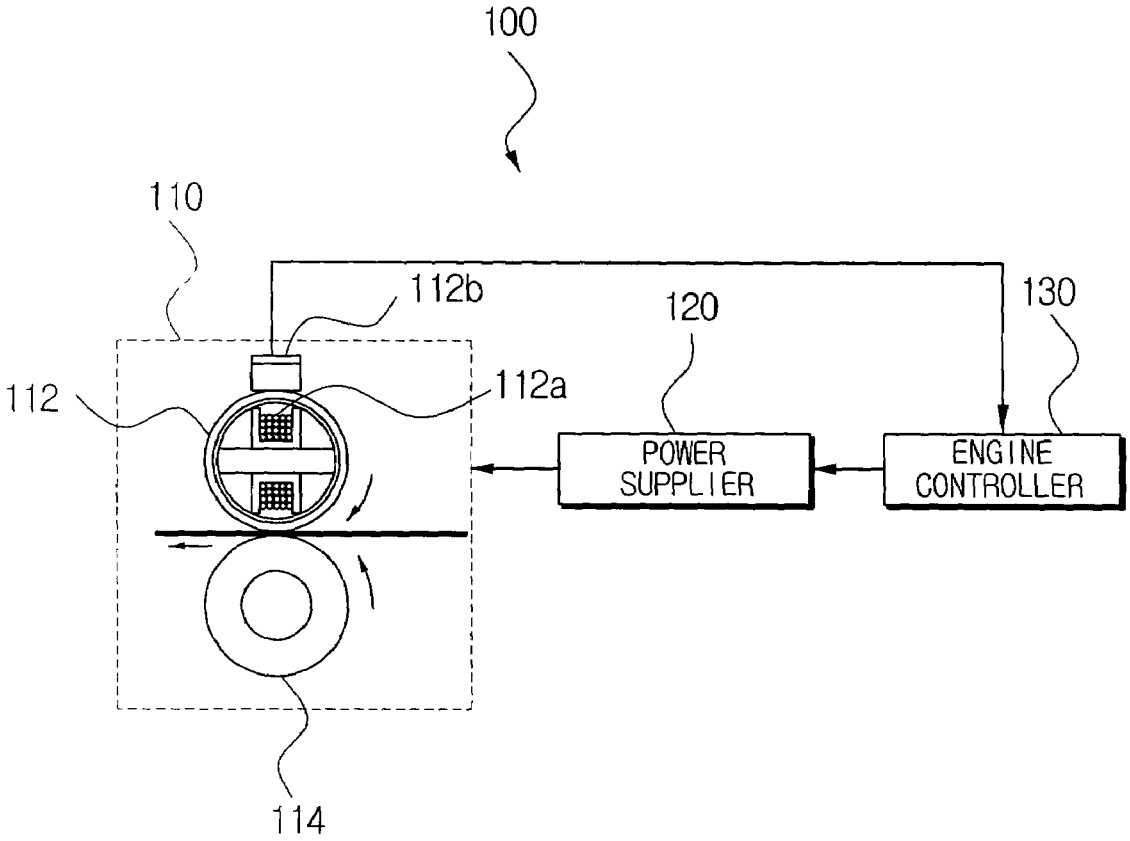
FIG. 1 (PRIOR ART)
FIG. 1 is a diagram showing a part of a conventional image forming apparatus employing an image fixing device.

Reference will now be made in detail to the present preferred embodiment of the present invention, an example of which is illustrated in the accompanying drawings, wherein like reference numerals refer to like elements throughout.

Figure 2:
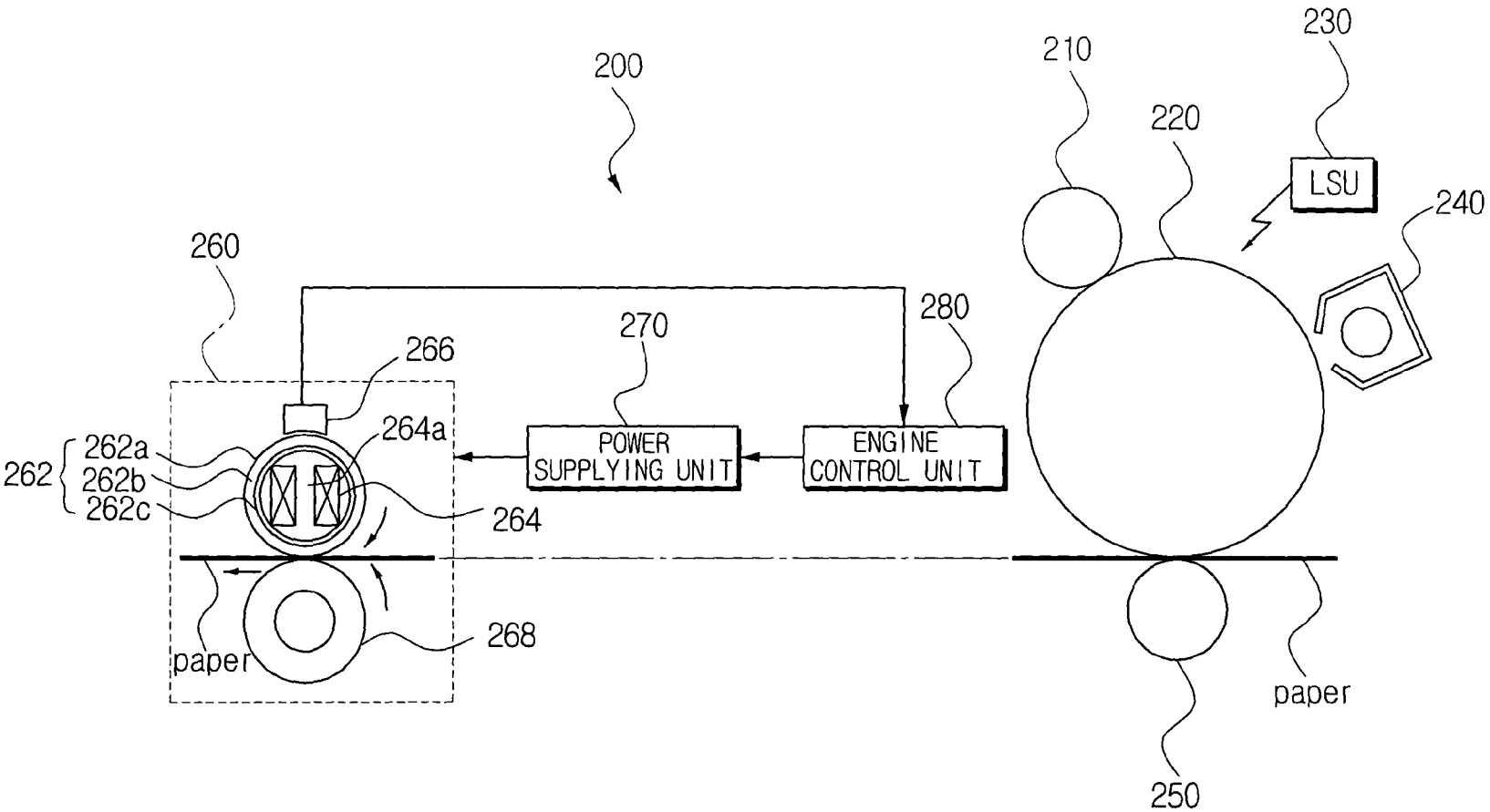
FIG. 2 is a schematic diagram showing an image forming apparatus having an image fixing device according to an embodiment of the present invention.

FIG. 2 is a schematic diagram showing an image forming apparatus having an image fixing device according to an embodiment of the present invention.

Referring to FIG. 2, the image forming apparatus 200 includes a charging roller 210 as a first roller, a photoconductor 220, a LSU ("Laser Scanning Unit") 230, a developing unit 240, a transferring roller 250 as a second roller, an image fixing device 260, a power supplying unit 270 and an engine control unit 280.

A high voltage is applied to the charging roller 210 to uniformly charge the surface of the photoconductor 220, which rotates in contact with the charging roller 210.

As the LSU 230 emits the laser, an electrostatic latent image is formed on the surface of the photoconductor 220. The developing unit 240 provides the electrostatic latent image formed on the surface of the photoconductor 220 with a toner to develop the image.

The developed image on the photoconductor 220 is transferred to the printing paper as a recording medium by the potential difference between the photoconductor 220 and the transferring roller 250. The image fixing device 260 fixes the transferred image to the paper by applying a predetermined heat and pressure.

The image fixing device 260 includes a heating roller 262 and a pressure roller 268. The heating roller 262 applies heat to the paper, thereby fixing the transferred image to the paper. The heating roller 262 may be a heat pipe of a closed tube type having a hollow. The closed tube type heat pipe is a heat transmission device to propagate/circulate a large amount of heat even with a minor temperature difference by using a latent heat of an evaporating fluid.

The heating roller 262 of the closed tube type heat pipe includes an outer conductor 262*a*, a closed space 262*b* and an inner conductor 262*c*.

The closed space 262*b* formed between the outer conductor 262*a* and the inner conductor 262*c*, is vacuous. A working fluid is poured into the closed space 262*b*. The working fluid may use a substance capable of a phase change, according to a temperature change, such as distilled water.

Inside of the heating roller 262, i.e., in the closed space 262*b* of the heating roller 262, is disposed an induction heating coil 264 which is applied as a heating member. The heating member is an induction heating body generating a magnetic field to the heating roller 262. The induction heating coil 264 is coiled around a magnetic core (not shown).

The heating roller 262 is installed to rotate separately from the induction heating coil 264. For example, the induction heating coil 264 may be stationary while the heating roller 262 rotates. Alternately, the heating roller 262 and the induction heating coil 264 may be installed to rotate in different directions.

The power supplying unit 270 supplies an AC power of tens to hundreds of kHz to the induction heating coil 264, thereby generating an AC magnetic field around the induction heating coil 264. The generated magnetic field causes the inner conductor 262*c* of the heating roller 262 to generate heat.

The inner conductor 262*c* may be made of a material which is capable of generating heat in response to a change of the magnetic field.

An eddy current is generated on the surface of the inner conductor 262*c* of the heating roller 262 by the AC magnetic field which is generated by the induction heating coil 264, and, in turn, a Joule's heat is generated by an eddy current loss generated on the surface of the inner conductor 262*c*.

The Joule's heat generated by induction heating evaporates the fluid in the closed space 262*b*. The evaporated fluid circulates in the closed space 262*b* of the heating roller 262 to transfer the heat so that the temperature of the outer conductor 262*a* can reach a temperature necessary for fixing in a short period of time.

This kind of induction heating may shorten or eliminate a warm-up time for printing which is necessary for an initial operation of the image forming apparatus 200. Thus, the power supplying unit 270 does not need to supply an electric power to the image forming apparatus 200 until a print or copy command is applied thereto, but only needs to maintain a low power supply of less than 10 watts for warm-up.

A continuous circulation of the fluid keeps the temperature of the surface of the outer conductor 262*a* at a predetermined uniform temperature. Namely, the heating roller 262 has a uniform temperature distribution along a longitudinal direction as well as a circumferential direction thereof, and maintains a predetermined temperature or a range of the temperature. This enables a uniform fixation of the developing agent to the paper.

On the surface of the outer conductor 262*a* of the heating roller 262, a temperature sensor 266 is installed to detect the temperature of the heating roller 262 heated by the induction heating coil 264. The temperature sensor 266 may be a thermistor.

The engine control unit 280 controls the power supplying unit 270 in response to the temperature detected by the temperature sensor 266. Specifically, the power supplying unit 270 regulates an amount of AC power to be supplied to the heating roller 262 under the control of the engine control unit 280.

The pressure roller 268 rotates as if it is in contact with the heating roller 262 to apply pressure to the paper with the image transferred thereto, thereby fixing the transferred image to the paper. The heating roller 262 and the pressure roller 268 rotate respectively in the directions indicated by the arrows, to discharge the image-fixed paper in the direction indicated by the arrows.

The paper discharged from the image fixing device 260 is outputted through a discharge port (not shown) of the image forming apparatus 200.

The image forming apparatus in accordance with the present invention provides an image fixing device capable of keeping a temperature around the surface of the heating roller at the predetermined uniform temperature or at the predetermined range of uniform temperature. This is because the heating roller including the heat pipe generates the Joule's heat from the eddy currents by the magnetic field which is generated by the induction heating coil.

Although an embodiment of the present invention has been shown and described, it will be appreciated by those skilled in the art that changes may be made in this embodiment without departing from the principles and spirit of the invention, the scope of which is defined in the claims and their equivalents.

What is claimed is:

1. An image fixing device of an image forming apparatus comprising:

a pressure roller;

a heating member;

a heating roller, the heating member being installed therein, to rotate with the pressure roller to fix a developed image to a fed paper by applying heat generated by the heating member, wherein the heating roller is a heat pipe of a closed tube type, wherein the heat pipe of the closed tube type forms a closed space therein and has distilled water inside of the closed space;

a temperature sensor to detect a temperature of the heating roller; and a control unit to control a power supplied to the heating roller based upon the detected temperature, wherein the heating member and the heating roller rotate in opposite directions.

2. The image fixing device according to claim 1, wherein the heating member is an induction heating body to generate a magnetic field in the heating roller.

3. The image fixing device according to claim 1, wherein the heating roller rotates separately from the heating member.

4. An apparatus comprising:

a roller to rotate about an axis to fix a toner image to a paper, the roller comprising an outer surface having a uniform surface temperature in a direction of the axis;

a heater to heat the outer surface to the uniform surface temperature.

a temperature sensor to detect a current temperature of the roller; and a control unit to control a power supplied to the roller based upon the detected temperature to thereby maintain the uniform surface temperature, wherein the roller is a heat pipe of a closed tube type, heat pipe of the closed tube type forms a closed space therein and has distilled water inside of the closed space, and the heater and the roller rotate in opposite directions.

5. The apparatus according to claim 4, wherein the roller further comprises:

an outer conductor forming the outer surface; and an inner conductor to form a space with the outer conductor.

6. The apparatus according to claim 4, wherein the heater heats the distilled water in the space.

7. The apparatus according to claim 6, wherein the heater is a heating coil, and the inner conductor generates heat in response to a change in a magnetic field generated by the heating coil.

8. The apparatus according to claim 6, wherein the roller rotates separately from the heater.

9. The apparatus according to claim 4, wherein the distilled water changes phase according to the heat generated by the inner conductor.

10. The apparatus according to claim 9, wherein the phase changed working fluid is circulated within the space.

11. An apparatus comprising:

a roller to rotate about an axis to fix a toner image to a paper, the roller comprising an outer surface having a uniform surface temperature in a direction of the axis; and a heater inside the roller to heat the outer surface to the uniform surface temperature, wherein the heater and the roller rotate in opposite directions.

12. An image fixing device of an image forming apparatus comprising:

a pressure roller;

an induction heating coil; and a heating roller, the induction heating coil being installed therein, to rotate with the pressure roller to fix a developed image to a fed paper by applying heat generated by the induction heating coil, wherein the heating roller is a heat pipe of a closed tube type, the induction heating coil and the heating roller rotating in opposite directions.

13. An image forming apparatus, comprising:

a first roller to form an electrostatic latent image thereon;

a developer to develop the electrostatic latent image;

a second roller to transfer the developed image to a recording medium; and a fixing device to fix the transferred image to the recording medium, comprising:

a third roller to rotate about an axis to fix a toner image to the recording medium, the third roller comprising an outer surface having a uniform surface temperature in a direction of the axis, and a heater disposed within the third roller to heat the third roller, the heater and the third roller rotating in opposite directions.

* * * * *

UNITED STATES PATENT AND TRADEMARK OFFICE

CERTIFICATE OF CORRECTION

PATENT NO. : 7,095,973 B2
APPLICATION NO. : 10/625736
DATED : August 22, 2006
INVENTOR(S) : In-gu Kwak It is certified that error appears in the above-identified patent and that said Letters Patent is hereby corrected as shown below:

Column 5, Line 28, after “temperature” change “.” to --;--.

Column 6, Line 42, after “axis” change “,” to --;--.

Signed and Sealed this

Thirtieth Day of January, 2007

JON W. DUDAS
*Director of the United States Patent and Trademark Office*